US005496489A

United States Patent [19]

Dussault et al.

[11] Patent Number: 5,496,489

[45] Date of Patent: Mar. 5, 1996

[54] SOLID, TRANSPARENT SOAP COMPOSITION BASED ON FATTY ACID SALTS AND CONTAINING ISOPRENE GLYCOL

[75] Inventors: Lydia Dussault, Saint Nom la Breteche; Alain Caudet, Meudon, both of France

[73] Assignee: L'Oreal, Paris, France

[21] Appl. No.: 267,359

[22] Filed: Jun. 29, 1994

[30] Foreign Application Priority Data

Jul. 9, 1993 [FR] France ..... 93 08510

[51] Int. Cl.[6] ..... C11D 1/72

[52] U.S. Cl. ..... 252/134; 252/122; 252/132; 252/170; 252/DIG. 16

[58] Field of Search ..... 252/122, 132, 252/134, DIG. 16, 170

[56] References Cited

U.S. PATENT DOCUMENTS

| | | | |
|---|---|---|---|
| 3,598,746 | 8/1971 | Thaddeus | 252/122 |
| 4,165,293 | 8/1979 | Gordon | 252/118 |
| 4,803,067 | 2/1989 | Brunetta et al. | 424/63 |
| 4,980,078 | 12/1990 | Verite et al. | 252/118 |
| 4,988,453 | 1/1991 | Chambers et al. | 252/122 |
| 5,144,054 | 9/1992 | Shioya et al. | 556/445 |

FOREIGN PATENT DOCUMENTS

| | | |
|---|---|---|
| 4091018 | 3/1992 | Japan . |
| 4290810 | 10/1992 | Japan . |

OTHER PUBLICATIONS

Patent Abstracts of Japan, vol. 016, No. 320 (C–0962), Jul. 14, 1992.

Pantini, G. et al, "A Novel Emulsification Technique of Perfluoropolyethers", Seifen–Ole–Fette–Wachse, 116 Jg., No. 14/1990, pp. 503–504.

*Primary Examiner*—Paul Lieberman
*Assistant Examiner*—Wyatt B. Pratt
*Attorney, Agent, or Firm*—Jacobson, Price, Holman & Stern

[57] ABSTRACT

Soap composition in the form of a solid transparent cake having an improved hardness and an improved resistance to exudation. The composition contains, expressed by weight relative to the total weight of the composition, from 25 to 40% of a soap consisting of a salt of $C_{10}$–$C_{20}$ fatty acids or mixtures thereof, from 2 to 50% is isoprene glycol, from 0 to 48% of a transparency agent chosen from $C_2$–$C_6$ diols other than isoprene glycol, $C_3$–$C_6$ polyols, urea and mixtures thereof, the total concentration of b+c being between 25 and 50%; and water in an amount less than or equal to 25%.

10 Claims, No Drawings

SOLID, TRANSPARENT SOAP COMPOSITION BASED ON FATTY ACID SALTS AND CONTAINING ISOPRENE GLYCOL

The subject of present invention is a solid, transparent soap composition based on fatty acid salts and containing isoprene glycol.

Solid, transparent soap compositions are well known in the state of the art. They are generally formed, with or without alcohol, from soaps of tallow and/or coconut and/or castor oil plant fatty acids and transparency agents preferably chosen from polyols such as sugars, glycerine or glycols such as propylene glycol, ethylene glycol or mixtures of the latter.

In the case of alcohol-free solid soaps a soap content of less than 40%, in particular of less than 20%, of coconut fatty acid soaps is generally used in order to improve their transparency.

These compositions, which are known in the cosmetics field, may have the disadvantage of foaming poorly.

Application EP-A 0,336,803 describes a solid, transparent soap composition based on tallow fatty acid soap containing at least one 1,2-alkanediol having an improved foaming power. The transparency agents used in this composition are chosen from $C_2$–$C_6$ polyols such as, more particularly, glycerine, propylene glycol and sorbitol or possibly urea, as well as their mixtures.

U.S. Pat. No. 4,165,293 describes a solid, transparent soap containing a sodium soap, an anionic or amphoteric surface-active agent and a $C_2$–$C_6$ diol such as ethylene glycol, diethylene glycol, triethylene glycol, butylene glycol, pentamethylene glycol, hexylene glycol and dipropylene glycol, and preferably propylene glycol.

These solid, transparent soap compositions of the prior art, whether or not they contain a 1,2-alkanediol, have the disadvantages of being used up very rapidly, of becoming soft in hot and humid atmospheres and of becoming covered in water droplets.

The rate of consumption of the soap is linked to its hardness. The harder the soap, the slower it is used up.

Consequently, it would be desirable to develop a solid, transparent soap composition based on fatty acid soaps which not only has a markedly improved humidity behaviour but also has an increased hardness, in order to decrease the rate of consumption of the soap.

Document JP 88/126811 describes the use of isoprene glycol or 3-methyl-1,3-butylene glycol as a moistening agent in creams, milks, lotions, cleansing creams, eaux de toilette, make-up foundations, shampoos, cream conditioners, masks, lipsticks, eyeshadows and toothpastes.

The Applicant has surprisingly discovered that by introducing isoprene glycol into a solid soap composition based on fatty acid soaps, not only was a solid transparent soap composition having an improved humidity behaviour obtained, but also an increase in the hardness of the soap was obtained, and consequently a slower consumption of the latter.

The subject of the present invention is thus a cosmetic, detergent and foaming composition which takes the form of a solid, transparent soap based on fatty acid soaps, water and optionally transparency agents and/or surface-active agents and containing isoprene glycol.

Another subject of the invention is a washing process which uses the composition defined above.

Other subjects of the invention will become apparent on reading the description and the examples which follow.

The composition in accordance with the invention takes the form of a solid transparent cake containing, expressed by weight relative to the total weight of the composition:

a) from 25 to 40% of a soap consisting of a salt of $C_{10}$–$C_{20}$ fatty acids or mixtures thereof;

b) from 2 to 50% of isoprene glycol;

c) from 0 to 48% of a transparency agent chosen from $C_2$–$C_6$ diols other than isoprene glycol, $C_3$–$C_6$ polyols, urea and mixtures thereof, the total concentration of b+c being between 25 and 50%; and d) water in an amount less than or equal to 25%.

The soaps used in the present invention are well known in the art and are generally fatty acid soaps of tallow and/or of coconut and/or of castor oil plant. These soaps are preferably chosen from sodium salts, in particular from the sodium salts of $C_{16}$–$C_{20}$ fatty acids and the sodium salts of $C_{10}$–$C_{14}$ fatty acids or mixtures thereof. They are preferably used in proportions between 25 and 40%, in particular between 25 and 35%, relative to the total weight of the composition.

A preferred embodiment of the invention consists in using a soap containing a weight proportion of $C_{16}$–$C_{20}$ fatty acid sodium salts between 80 and 90% and a weight proportion of $C_{10}$–$C_{14}$ fatty acid sodium salts between 10 and 20% relative to the total amount of soap.

The transparency agents, other than isoprene glycol, when they are used in the compositions of the present invention, are chosen from $C_2$–$C_6$ diols, $C_3$–$C_6$ polyols, urea and mixtures thereof. Propylene glycol, glycerine and sorbitol are more particularly recommended.

The amount of transparency agent used is equal to or less than 48% by weight relative to the total weight of the composition and is such that the sum of the concentration of transparency agent and of the concentration of isoprene glycol is between 25 and 50% by weight relative to the total weight of the composition.

As indicated above, the soap composition according to the invention contains from 2 to 50% by weight, relative to the total weight of the composition, of isoprene glycol. Isoprene glycol acts, not only in the composition as a transparency agent, but also improves the humidity behaviour and increases the final hardness of the composition. The soap composition according to the invention will preferably contain from 5 to 30% of isoprene glycol and even better from 8 to 25% by weight.

The composition of the present invention may optionally also contain anionic, amphoteric, nonionic or cationic surface-active agents, with the aim of improving the foaming power of the soap. These surface-active agents, when they are used in the compositions of the present invention, are present in proportions less than or equal to 20% by weight relative to the total weight of the composition and preferably less than or equal to 10% by weight.

Between 4 and 8% by weight of surface-active agent, relative to the total weight of the composition, is preferably used in the compositions of the present invention.

Among the anionic or nonionic surface-active agents which may be used in the present invention, there may be mentioned those described in Patent Application EP-A-0,336,803 and in U.S. Pat. No. 4,165,293.

Among the anionic surface-active agents, there may be mentioned alkali metal salts, ammonium salts, amine salts, amino alcohol salts, the magnesium salts of the following compounds: alkyl sulphates, alkyl ether sulphates, alkylamidoether sulphates, alkylarylpolyether sulphates, monoglyceride sulphates; alkyl sulphonates, alkyl ether sulphonates, alkylamide sulphonates; alkylarylsulphonates, olefin sulphonates, paraffin sulphonates, alkyl sulphosuccinates, alkyl ether sulphosuccinates, alkylamide sulphosuccinates, alkyl sulphosuccinamates, alkyl sulphoacetates, alkyl ether phosphates, acylsarcosinates, N-acyltaurates, acylglutamates and isethionates.

The alkyl or acyl radical of these various compounds generally consists of a carbon chain containing from 10 to 20 carbon atoms.

It is also possible to use weakly anionic surface-active agents such as polyoxyalkylenated alkylamide or alkyl ether carboxylic acids, such as those containing 2 to 50 ethylene oxide groups.

The nonionic surface-active agents are more particularly chosen from polyethoxylated or polypropoxylated fatty acids or alkylphenols or α-diols or alcohols having a fatty chain which contains 8 to 18 carbon atoms, the number of ethylene oxide or propylene oxide groups being between 2 and 50 and the number of glycerol groups being between 2 and 30.

There may more particularly be mentioned copolymers of ethylene oxide and propylene oxide; condensates of ethylene oxide and propylene oxide with fatty alcohols; polyethoxylated fatty amides preferably having 2 to 30 moles of ethylene oxide; polyethoxylated fatty amines preferably having 2 to 30 moles of ethylene oxide; oxyethylenated fatty acid esters of sorbitan preferably having 2 to 30 moles of ethylene oxide; fatty acid esters of sugar, fatty acid esters of polyethylene glycol, fatty acid esters of glycols, amine oxides such as $(C_{10}-C_{14})$alkylamine oxides or N-acylamidopropylmorpholine oxides, and $(C_8-C_{18})$alkylpolyglycosides.

The preferred amphoteric or zwitterionic surface-active agents are secondary or tertiary aliphatic amine derivatives, in which the aliphatic radical is a linear or branched chain containing 8 to 18 carbon atoms and which contains at least one anionic water-solubilizing carboxylate, sulphonate, sulphate, phosphate or phosphonate group; $(C_8-C_{20})$alkyl betaines, sulphobetaines, $(C_8-C_{20})$alkylamido$(C_1-C_6)$alkyl betaines or $(C_8-C_{20})$alkylamido$(C_1-C_6)$alkyl sulphobetaines.

Alkyl peptides and alkylimidazoliumbetaines may also be mentioned.

Among the amine derivatives, there may be mentioned the products marketed under the name "MIRANOL", such as those described in U.S. Pat. Nos. 2,528,378 and 2,781,354 or classified in the CTFA dictionary, 3rd edition, 1982, under the names Amphocarboxyglycinates or Amphocarboxypropionates.

The cationic surface-active agents are chosen from quaternary ammonium salts such as $(C_8-C_{22})$alkyltrimethylammonium halides, $(C_8-C_{22})$dialkyldimethylammonium halides and $(C_8-C_{22})$alkyldimethylhydroxyethylammonium halides.

It is also possible to add to the compositions according to the invention $C_{10}-C_{18}$ 1,2-alkanediols, such as those described in Application EP-A-0,336,803, in order to improve the foaming properties of the soap. When they are used in the compositions of the present invention, these $C_{10}-C_{18}$ 1,2-alkanediols represent 10% by weight or less relative to the total weight of the composition. The 1,2-alkanediols which may be used in the present invention are saturated compounds with a linear chain containing an odd or even number of carbon atoms which may contain from 10 to 18 and preferably from 10 to 14 carbon atoms. The preferred 1,2-alkanediol is 1,2-dodecanediol. They may commonly be obtained by hydroxylation of the corresponding α-olefins or hydrolysis of the corresponding epoxides.

The 1,2-alkanediol is preferably used in weight proportions equal to or less than 10%, generally between 3 and 10%, preferably between 4 and 8% and even more particularly between 5 and 7% relative to the total weight of the composition.

The compositions of the present invention may also contain anti-oxidizing agents and sequestering or chelating agents such as the tetrasodium salt of ethylenediaminetetraacetic acid or the tetrasodium salt of 1-hydroxyethylidenediphosphonic acid. They are used in proportions of 0.1 to 0.5% by weight relative to the total weight of the composition.

The solid, transparent soap compositions according to the invention may also contain adjuvants which do not modify their transparency, such as pearling agents and volatile or non-volatile silicones, which may or may not be organically modified, at a content of less than 5% by weight, ceramides, perfluoropolyethers, skin conditioning agents such as polymers, aloes or mallow extracts, sunflower oil or collagen at a content of less than 2% by weight. The compositions in accordance with the invention may additionally contain active ingredients for treating the skin, such as anti-acne agents and antibacterial agents; they may also contain dyes, perfumes and other adjuvants commonly used in cosmetics.

The solid, transparent soaps according to the invention are prepared in a standard manner by heating the fatty acids and the fatty substances to 75°–80° C. in order to melt them and to obtain a homogeneous medium. Isoprene glycol and optionally the other ingredients such as the transparency agents, the 1,2-alkanediols, the surface-active agents and the other adjuvants are then added. Sodium hydroxide dissolved in water is subsequently added with stirring; the stirring is continued for approximately 30 minutes. The soaps are cast in the form of cakes at a temperature of 80°–85° C. and are then left to cool in order to obtain the solid, transparent soaps according to the invention, in the form of cakes.

Another subject of the invention is a process for washing the skin, characterized in that a solid and transparent soap as defined above is applied to the skin.

The examples which follow illustrate the invention without, however, limiting it.

In the examples which follow, the penetration index of the soap was measured by measuring the degree of penetration of a needle into the soap to a 10th of a millimeter.

A Prolabo electric penetrometer with an automatic time delay trigger was used.

The tests were carried out on a cake of soap dried for 24 hours at the room temperature (RT) of 25° C. and after heating at 45° C. for 30 hours.

The method for measuring the penetration index consists in placing the soap on the penetrometer platform and then in disengaging the head of the penetrometer from the support rod and in lowering the head in order to bring the tip of the needle slightly above the surface of the soap. The needle is immobilized in this position. The vertical position of the head is finely adjusted using a micrometric adjusting key, in order to bring the tip of the needle just in contact with the surface of the soap.

A feeler is brought in contact with the top of the support rod using a control button. Using the graduated dial of the apparatus, and by turning it, the graduation 0 is brought in line with the needle. The trigger time is preset to 5 seconds. The penetrometer is then triggered and the depth to which the needle has entered is read on the dial, in 10ths of a mm. The measurement is repeated at least 6 times, with variation of the position of penetration.

The penetration index of the soap is the average value of the measurements made.

The humidity behaviour is demonstrated by placing the cake of soap in a chamber in which there is an atmosphere at a relative humidity of 80% and which is at room temperature, and the formation of water droplets on the surface of the cake of soap is observed visually. The time at which these water droplets appear is noted.

COMPARATIVE EXAMPLE

A solid, transparent cake of soap having the following composition is prepared:

| | |
|---|---|
| 50/50 mixture of stearic acid and palmitic acid | 23.62 g |
| Lauric acid | 4.10 g |
| Sodium hydroxide | 4.26 g |
| Propylene glycol | 21.8 g |
| Aqueous 70% sorbitol solution | 10 g AS |
| Glycerine | 7.5 g |
| 1,2-Dodecanediol | 5.65 g |
| Anti-oxidizing agent, sequestering agent, perfume, dye | qs |
| Sodium ($C_{12}$–$C_{14}$)alkyl ether sulphate containing 2.2 moles of EO in 70% aqueous solution | 6.1 g AS |
| Water qs | 100 g |

EXAMPLE 1

A solid, transparent cake of soap according to the invention and having the following composition is prepared:

| | |
|---|---|
| 50/50 mixture of stearic acid and palmitic acid | 23.62 g |
| Lauric acid | 4.1 g |
| NaOH | 4.26 g |
| Isoprene glycol | 21.8 g |
| Aqueous 70% sorbitol solution | 10 g AS |
| Glycerine | 7.5 g |
| 1,2-Dodecanediol | 5.65 g |
| Sodium ($C_{12}$–$C_{14}$)alkyl ether sulphate containing 2.2 moles of EO in 70% aqueous solution | 6.1 g AS |
| Anti-oxidizing agent, sequestering agent, perfume, dye | qs |
| Water qs | 100 g |

The penetration index was measured at room temperature and at 45° C. for the composition of Example 1 and for the composition of the comparative example, as indicated above. The humidity behaviour was also determined for these two compositions.

The results are presented in Table I below.

EXAMPLE 2

A solid, transparent cake of soap having the following composition is prepared:

| | |
|---|---|
| 50/50 mixture of stearic acid and palmitic acid | 23.6 g |
| Lauric acid | 4.1 g |
| NaOH | 4.28 g |
| Isoprene glycol | 10.65 g |
| Propylene glycol | 10.65 g |
| Aqueous 70% sorbitol solution | 9.65 g AS |
| Glycerine | 7.5 g |
| 1,2-Dodecanediol | 5.65 g |
| Sodium ($C_{12}$–$C_{14}$)alkyl ether sulphate containing 2.2 moles of EO in 70% aqueous solution | 6.1 g AS |
| Oxyethylenated stearyl alcohol containing 20 moles of EO sold by the company ICI under the name BRIJ 58 | 5 g |

-continued

| | |
|---|---|
| Anti-oxidizing agent, sequestering agent, perfume, dye | qs |
| Water qs | 100 g |

EXAMPLE 3

A solid, transparent cake of soap having the following composition is prepared:

| | |
|---|---|
| 50/50 mixture of stearic acid and palmitic acid | 23.6 g |
| Lauric acid | 4.1 g |
| NaOH | 4.27 g |
| Isoprene glycol | 21.8 g |
| Aqueous 70% sorbitol solution | 10 g AS |
| Glycerine | 7.5 g |
| Sodium ($C_{12}$–$C_{14}$)alkyl ether sulphate containing 2.2 moles of EO in 70% aqueous solution | 10.5 g AS |
| Anti-oxidizing agent, sequestering agent, perfume, dye | qs |
| Water qs | 100 g |

TABLE I

| | Penetration index after 30 hours at | | Time for the appearance of the water droplets on the |
|---|---|---|---|
| | R.T. | 45° C. | surface of the soap |
| Comparative Example | 27/28 | 63 | 24 hours |
| Example 1 | 25/26 | 55/56 | six weeks |

The solid, transparent cake of soap of Example 1, which differs from the cake of the comparative example in that the propylene glycol was replaced with isoprene glycol, exhibits better humidity behaviour and greater hardness.

We claim:

1. Composition in the form of a solid, transparent cake containing, expressed by weight relative to the total weight of the compositions, a) from 25 to 40% of a soap consisting of a salt of $C_{10}$–$C_{20}$ fatty acids or mixtures thereof;

b) from 2 to 50% of isoprene glycol;

c) from 0 to 48% of a transparency agent selected from the group consisting of $C_2$–$C_6$ diols other than isoprene glycol, $C_3$–$C_6$ polyols, urea and mixtures thereof, the total concentration of b+c being between 25 and 50%; and d) water in an amount less than or equal to 25%.

2. Composition according to claim 2, wherein the isoprene glycol represents from 8 to 25% by weight relative to the total weight of the composition.

3. Composition according to claim 1, wherein the transparency agent is selected from the group consisting of propylene glycol, glycerine, sorbitol and mixtures thereof.

4. Composition according to claim 1, wherein the composition additionally contains 20% by weight or less, relative to the total weight of the composition, of an anionic, amphoteric, nonionic or cationic surface-active agent.

5. Composition according to claim 4, wherein the surface-active agent is alkali metal salts, ammonium salts, amine salts, amino alcohol salts, the magnesium salts of the following compounds: alkyl sulphates, alkyl ether sulphates, alkylamidoether sulphates, alkylarylpolyether sulphates, monoglyceride sulphates; alkyl sulphonates, alkyl ether sulphonates, alkylamide sulphonates; alkylarylsulphonates, olefin sulphonates, paraffin sulphonates, alkyl sulphosuccinates, alkyl ether sulphosuccinates, alkylamide sulphosuccinates, alkyl sulphosuccinates, alkyl sulphoacetates, alkyl ether phosphates, acylsarcosinates, N-acyltaurates, acylglutamates, isethionates, polyoxyalkylenated alkylamide or alkyl ether carboxylic acids, polyethoxylated or polypropoxylated fatty acids or alkylphenols or α-diols or alcohols having a fatty chain which contains 8 to 18 carbon atoms, the number of ethylene oxide or propylene oxide groups being between 2 and 50 and the number of glycerol groups being between 2 and 30, secondary or tertiary aliphatic amine derivatives, in which the aliphatic radical is a linear or branched chain containing 8 to 18 carbon atoms and which contains at least one anionic water-solubilizing carboxylate, sulphonate, sulphate, phosphate or phosphonate group; $(C_8–C_{20})$ alkyl betaines, sulphobetaines, $(C_8–C_{20})$alkylamido$(C_1–C_6)$alkyl betaines or $(C_8–C_{20})$alkylamido$(C_1–C_6)$alkyl sulphobetaines, ethyl peptides, alkylimidazolium betaines or quaternary ammonium salts.

6. Composition according to claim 1, wherein the composition additionally contains 10% by weight or less, relative to the total weight of the composition, of a $C_{10}–C_{18}$ 1,2-alkanediol or a mixture thereof.

7. Composition according to claim 6, wherein the 1,2-alkanediol is 1,2-dodecanediol.

8. Composition according to claim 1, wherein the composition additionally contains adjuvants which are sequestering agents, pearling agents, volatile or non-volatile silicones, skin conditioning agents, ceramides, aloes or mallow extracts, sunflower oil, collagen, dyes or perfluoropolyethers.

9. Composition according to claim 1, wherein the composition contains anti-acne agents or anti-bacterial agents for treating the skin.

10. Process for washing the skin, comprising applying to the skin a cosmetic composition in the form of a solid transparent cake as claimed in claim 1.

* * * * *